US008117846B2

(12) United States Patent
Wilbraham

(10) Patent No.: US 8,117,846 B2
(45) Date of Patent: Feb. 21, 2012

(54) GAS TURBINE BURNER AND METHOD OF MIXING FUEL AND AIR IN A SWIRLING AREA OF A GAS TURBINE BURNER

(75) Inventor: Nigel Wilbraham, Stourbridge (GB)

(73) Assignee: Siemens Aktiengesellschaft, Munich (DE)

( * ) Notice: Subject to any disclaimer, the term of this patent is extended or adjusted under 35 U.S.C. 154(b) by 679 days.

(21) Appl. No.: 12/223,889

(22) PCT Filed: Dec. 28, 2006

(86) PCT No.: PCT/EP2006/070236

§ 371 (c)(1),
(2), (4) Date: Aug. 12, 2008

(87) PCT Pub. No.: WO2007/093248

PCT Pub. Date: Aug. 23, 2007

(65) Prior Publication Data

US 2010/0223932 A1 Sep. 9, 2010

(30) Foreign Application Priority Data

Feb. 15, 2006 (EP) ..... 06003056

(51) Int. Cl.
*F02C 1/00* (2006.01)

(52) U.S. Cl. ..... 60/748; 60/737

(58) Field of Classification Search ..... 60/748, 60/39.11, 737, 776; 239/403; 431/19, 182, 431/183

See application file for complete search history.

(56) References Cited

U.S. PATENT DOCUMENTS

| | | | | |
|---|---|---|---|---|
| 3,455,108 | A | 7/1969 | Harold | |
| 5,816,049 | A | 10/1998 | Joshi | |
| 6,220,034 | B1 * | 4/2001 | Mowill | 60/737 |
| 6,513,329 | B1 | 2/2003 | Snyder et al. | |
| 6,951,108 | B2 | 10/2005 | Burrus et al. | |
| 2001/0045094 | A1 * | 11/2001 | Wilbraham | 60/740 |
| 2001/0052229 | A1 | 12/2001 | Battaglioli et al. | |
| 2002/0174656 | A1 | 11/2002 | Hein | |
| 2004/0142294 | A1 | 7/2004 | Grienche et al. | |

FOREIGN PATENT DOCUMENTS

| | | | |
|---|---|---|---|
| EP | 0936406 | A2 | 8/1999 |
| EP | 1139020 | A1 | 10/2001 |
| EP | 1321714 | A2 | 6/2003 |
| EP | 1371906 | A2 | 12/2003 |
| SU | 1310581 | A1 | 5/1987 |
| SU | 1636631 | A1 | 3/1991 |

* cited by examiner

*Primary Examiner* — Ehud Gartenberg
*Assistant Examiner* — Vikansha Dwivedi

(57) ABSTRACT

A gas turbine burner, comprising at least one swirler, the swirler having at least one air inlet opening, at least one air outlet opening positioned downstream to the air inlet opening and at least one swirler air passage extending from the at least one air inlet opening to the at least one air outlet opening which is delimited by swirler air passage walls; a fuel injection system which comprises fuel injection openings arranged in at least one swirler air passage wall so as to inject fuel into the swirler air passage; and an air injection system which comprises air injection openings arranged in at least one swirler air passage wall and positioned downstream of the fuel injection openings for injecting air into the swirler air passage.

7 Claims, 2 Drawing Sheets

GAS TURBINE BURNER AND METHOD OF MIXING FUEL AND AIR IN A SWIRLING AREA OF A GAS TURBINE BURNER

CROSS REFERENCE TO RELATED APPLICATIONS

This application is the US National Stage of International Application No. PCT/EP2006/070236, filed Dec. 28, 2006 and claims the benefit thereof. The International Application claims the benefits of European application No. 06003056.6 filed Feb. 15, 2006, both of the applications are incorporated by reference herein in their entirety.

FIELD OF INVENTION

The present invention relates to a gas turbine burner having an air inlet duct and at least one swirler disposed in said air inlet duct. In addition, the invention relates to a method of mixing fuel and air in a swirling area of a gas turbine burner.

BACKGROUND OF THE INVENTION

In a gas turbine burner a fuel is burned to produce hot pressurised exhaust gases which are then fed to a turbine stage where they, while expanding and cooling, transfer momentum to turbine blades thereby imposing a rotational movement on a turbine rotor. Mechanical power of the turbine rotor can then be used to drive a generator for producing electrical power or to drive a machine. However, burning the fuel leads to a number of undesired pollutants in the exhaust gas which can cause damage to the environment. Therefore, it takes considerable effort to keep the pollutants as low as possible. One kind of pollutant is nitrous oxide ($NO_x$). The rate of formation of nitrous oxide depends exponentially on the temperature of the combustion flame. It is therefore attempted to reduce the temperature over the combustion flame in order to keep the formation of nitrous oxide as low as possible.

There are two main measures by which reduction of the temperature of the combustion flame is achievable. The first is to use a lean stoichiometry, e.g. a fuel/air mixture with a low fuel fraction. The relatively small fraction of fuel leads to a combustion flame with a low temperature. The second measure is to provide a thorough mixing of fuel and air before the combustion takes place. The better the mixing is the more uniformly distributed the fuel is in the combustion zone. This helps to prevent hotspots in the combustion zone which would arise from local maxima in the fuel/air mixing ratio.

Modern gas turbine engines therefore use the concept of premixing air and fuel in lean stoichiometry before the combustion of the fuel/air mixture. Usually the pre-mixing takes place by injecting fuel into an air stream in a swirling zone of a combustor which is located upstream from the combustion zone. The swirling leads to a mixing of fuel and air before the mixture enters the combustion zone.

U.S. Pat. No. 6,513,329 B1 describes a premixing of fuel and air in a mixing chamber of a combustor. The mixing chamber extends along, and is at least partly wound around, a longitudinal axis of the burner. Two rows of fuel injection passages are located in the outer wall of the mixing chamber axis. The outlet opening of the mixing chamber is formed by slots extending parallel to the longitudinal burner axis. By this construction, the fuel/air mixture leaving the mixing chamber has, in addition to an axial streaming component with respect to the burner axis, a radial streaming component.

US 2001/0052229 A1 describes a burner with uniform fuel/air premixing for low emissions combustion. The burner comprises an air inlet duct and a swirler disposed in the air inlet duct. The swirler comprises swirler vanes with primary and secondary gas passages and corresponding gas inlet openings. Fuel flow through the two gas passages to the inlet openings is controlled independently, and enables control over the radial fuel/air concentration distribution profile from the swirl slot base to its tip. The secondary gas inlet openings are located downstream from the primary gas inlet openings.

SUMMARY OF INVENTION

With respect to the mentioned state of the art it is an object of the invention to provide a burner, in particular a gas turbine burner, and a method of mixing fuel and air in a swirling area of a burner, in particular of a gas turbine burner, which is advantageous in providing a homogenous fuel/air mixture.

This object is solved by a burner and a method according to the claims. The dependent claims describe advantageous developments of the invention.

An inventive burner comprises an air inlet duct and at least one swirler disposed in said air inlet duct. The swirler has at lest one air inlet opening, at least one air outlet opening positioned downstream from the air inlet opening relative to the streaming direction of the air passing through the air inlet duct and at least one swirler air passage extending from the at least one air inlet opening to the at least one air outlet opening. The swirler is delimited by swirler air passage walls which can be formed by a wall of the air inlet duct and/or swirler vanes. In addition, the inventive burner comprises a fuel injection system and an air injection system. The fuel injection system, which can generally be adapted for injection of gaseous or liquid fuels, comprises fuel injection openings, for example nozzles, which are arranged in at least one swirler air passage wall so as to inject fuel into the swirler air passage. The air injection system comprises air injection openings, for example nozzles, which are arranged in at least one swirler air passage wall and positioned downstream of the fuel injection openings for injecting air into the swirler air passage.

The air injection holes inside the swirler air passage are used to produce additional turbulence in the streaming medium which in turn helps to increase the rate of fuel and air mixing in the swirler air passage. Consequently, a better distribution of the injected fuel can be achieved over the cross section of the swirler air passage. In addition, the homogeneity of the fuel/air mixture over the cross section area can be increased.

In a particular realisation of the inventive burner, the air passage walls are formed at least partly by swirler vanes and the air injection openings are arranged in the swirler vanes. As in burners for gas turbine engines, the fuel injection openings are often arranged in the swirler vanes, arranging the air injection openings in the swirler vanes to, allows air to be injected in more or less the same direction as the fuel is injected, in particular perpendicular to the streaming direction of the air streaming through the air passages. However, different fuel injection directions and air injection directions are, in general, possible.

In a further development of the inventive burner, the air injection system comprises a plurality of air injection openings for each swirler air passage which are distributed over at least one swirler air passage wall. By distributing the air injection openings over at least one swirler air passage wall the formation of turbulences and, as a consequence, the mixing of fuel and air can be optimised. If the air injection system comprises a control mechanism for controlling air allocation to the distributed air inlet openings, it is possible to adapt the air injection to different conditions of the burner. This provides flexible control on fuel placement through a wide range of burner conditions. The combustion system thus will be enabled to accommodate the changes in air density and flow rates experienced, for example at off-design conditions, more readily than it is possible with existing burner systems. Moreover, by varying the combination of injection holes used to introduce turbulences, the fuel air mixture may be shifted, e.g. towards the upstream end or towards the downstream end of the swirler air passage.

An inventive gas turbine engine comprises an inventive burner. The inventive burner helps to reduce the fraction of nitrous oxide in the exhaust gases of a gas turbine engine.

In the inventive method of mixing fuel and air in a swirling area of a burner, in particular a gas turbine burner, fuel is injected into an air stream streaming through a swirler air passage. Additional air, i.e. air which is additional to the air stream streaming through the swirler air passage, is injected downstream of the location of the fuel injection into the fuel/air mixture stream streaming through the swirler air passage.

By injecting additional air into the streaming medium additional turbulence can be formed which helps to improve the mixing of air and fuel and the homogeneity of the mixture. This in turn reduces the formation of hot spots which are the main areas of nitrous oxide formation. As a consequence, reduction of the number and the temperature of hot spots reduces the emission of nitrous oxides from the burner.

Injecting air at least two different positions into the medium streaming through the swirler air passage provides an additional degree of freedom which can be used to provide an optimum mixing of fuel and air and an optimum homogeneity of the mixture.

If an allocation of additional air to the at least two different positions is made dependent on one or more burner conditions, it is possible to adapt the injection of additional air to changes of this one or more burner conditions. When, for example, the inventive method is used in a burner of a gas turbine engine, the allocation can be performed on the basis of the load conditions of the gas turbine.

The inventive burner is particularly adapted to perform the inventive method.

BRIEF DESCRIPTION OF THE DRAWINGS

Further features, properties and advantages of the present invention will become clear from the following description of embodiments of the invention in conjunction with the accompanying drawings.

DETAILED DESCRIPTION OF INVENTION

Figure 1:
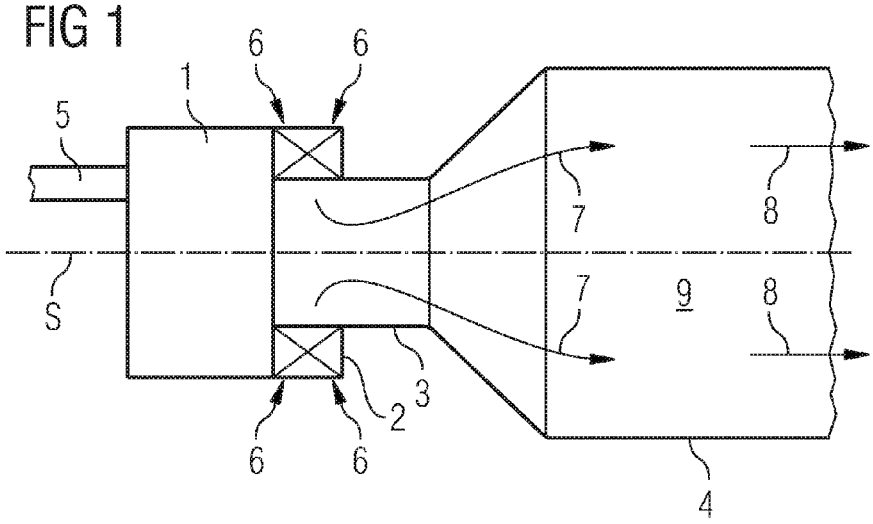
FIG. 1 shows a section through an inventive burner and a combustion chamber assembly.

FIG. 1 shows a longitudinal section through a burner and combustion chamber assembly for a gas turbine engine. A burner head 1 with a swirler for mixing air and fuel is attached to an upstream end of a combustion chamber comprising, in flow series, a combustion pre-chamber 3 and a combustion main chamber 4. The burner and the combustion chamber assembly show rotational symmetry about a longitudinally symmetry axis S. A fuel conduit 5 is provided for leading a gaseous or liquid fuel to the burner which is to be mixed with in-streaming air in the swirler 2. The fuel air mixture 7 is then led towards the primary combustion zone 9 where it is burnt to form hot, pressurised exhaust gases streaming in a direction 8 indicated by arrows to a turbine of the gas turbine engine (not shown).

Figure 2:
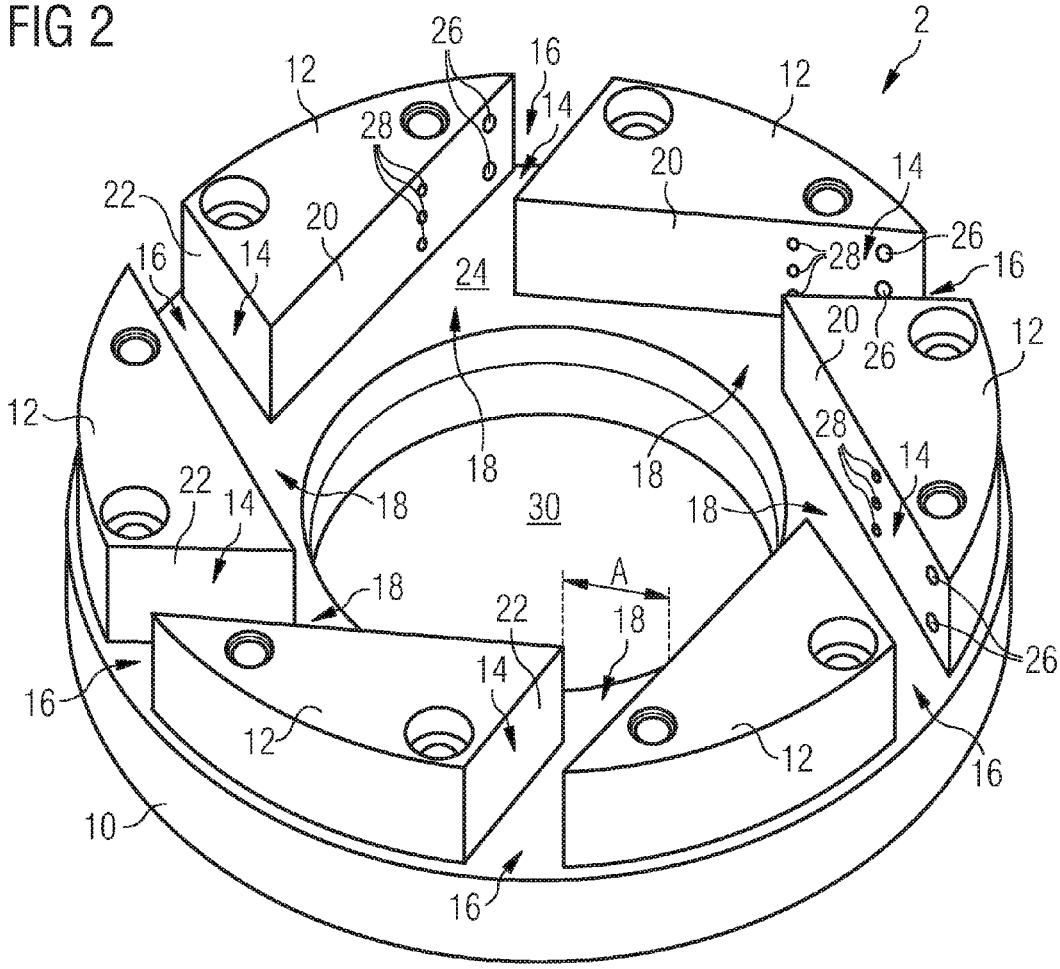
FIG. 2 shows a perspective view of a swirler shown in FIG. 1.

The swirler 2 is shown in detail in FIG. 2. It comprises a swirler vane support 10 carrying six swirler vanes 12. The swirler vanes 12 can be fixed to the burner head 1 with their sides opposite to the swirler vane support 10.

Between neighbouring swirler vanes 12 air passages 14 are formed which each extend between an air inlet opening 16 and an air outlet opening 18. The air passages 14 are delimited by opposing end faces 20, 22 of neighbouring swirler vanes 12, by the surface 24 of the swirler vane support which shows to the burner head 1 and by a surface of the burner head 1 to which the swirler vanes 12 are fixed. The end faces 20, 22, the surfaces of the swirler vane support 10 and of the burner head 1 form the air passage walls delimiting the air passages 14.

In the end faces 20 fuel injection openings 26 and air injection openings 28 are present. During operation of the burner, air is taken in into the swirler passages 14 through the air inlet openings 16. Within the air passages 14 fuel is injected into the streaming air by use of the fuel injection openings 26. In addition, air is injected into the streaming fuel/air mixture downstream from the fuel injection openings 26 by the air injection openings 28. The fuel/air mixture then leaves the air passages 14 through the air outlet openings 18 and streams through a central opening 30 of the swirler vane support 10 into the pre-chamber 3 (see FIG. 1). From the pre-chamber 3 it streams into the combustion zone 9 of the main chamber 4 where it is burned.

Figure 3:
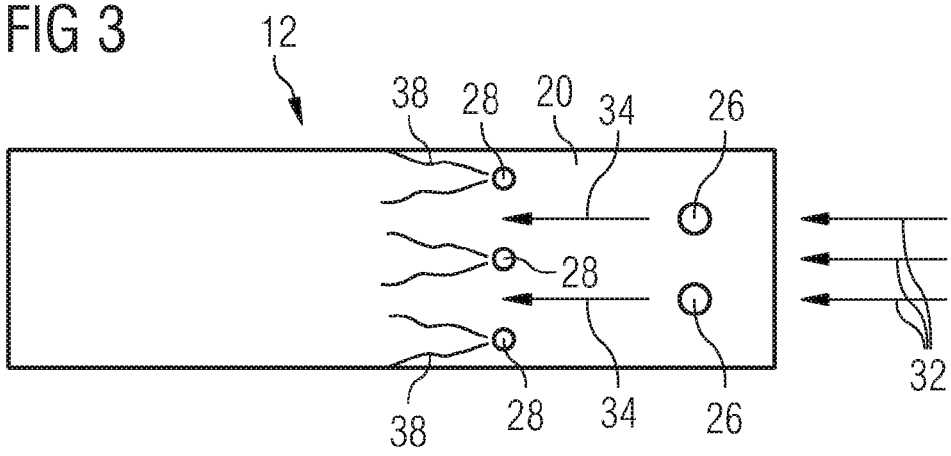
FIG. 3 shows a section, in streaming direction of the air, through an air passage of the swirler for a first embodiment of the inventive burner.
Figure 4A:
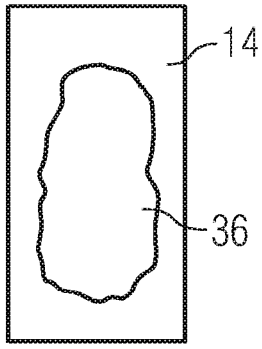
FIG. 4*a* schematically shows the distribution of fuel in the air stream through an air passage of the swirler for a state of the art burner in a section perpendicular to the streaming direction.

FIG. 3 shows the end face 20 of a swirler vane 12. The instreaming air is indicated by the arrows 32. The fuel 34 injected through the fuel injection openings 26 then streams together with the instreaming air 32. The geometry of the swirler imposes a radial velocity component on the streaming fuel/air mixture with respect to the central symmetry axis S of the burner. This already distributes the injected fuel in the direction perpendicular to the streaming direction of the air. Such a fuel distribution 36 is exemplarily shown in FIG. 4A which shows a section through an air passage 14 which is indicated in FIG. 2 by A-A.

Figure 4B:
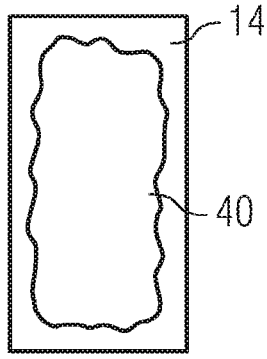
FIG. 4*b* schematically shows the fuel distribution according to FIG. 4*a* for an inventive burner.

In the inventive burner the additional air 38 injected through the air injection openings 28 lead to additional turbulence in the streaming fuel/air mixture. As a result of this additional turbulence, the fuel injected by the fuel injection openings 26 will migrate further across the air passage 14 than without the additional turbulence. The fuel distribution 40 generated by the additional air 38 injected through the air injection openings 28 is shown exemplarily in FIG. 4B which is a sectional view through an air passage 14 according to the sectional view of FIG. 4A. By positioning the air injection openings 28 relatively to the fuel injection openings 26 the rate of fuel and air mixing over the length of the swirler air passage 14 can be set.

Figure 5:
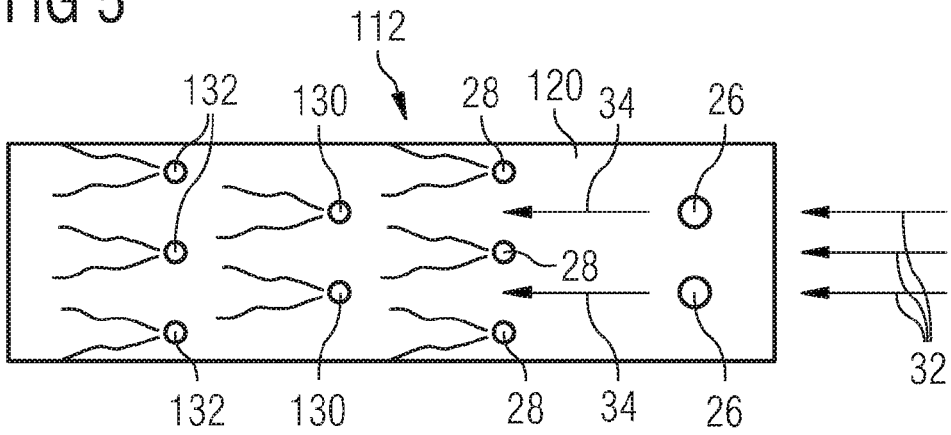
FIG. 5 shows a second embodiment of the inventive burner in a section, in the streaming direction of the air, through the air passage of the swirler.

FIG. 5 shows the end face 120 of a second embodiment of a swirler used in an inventive burner. The swirler itself differs from the swirler 2 shown in FIG. 2 only by the design of the end face 120. In comparison to the end face 20 of the first embodiment, more air injection openings 130, 132 are present further downstream from the fuel injection openings 26 in addition to the air injection openings 20. By the additional air injection openings 130, 132 the level of turbulence generation by injecting additional air can be further increased. Moreover, it is possible to control distribution of injected air by setting air allocation to the different air injection openings. This may be accomplished by individual air ducts supplying the different air injection openings 28, 130, 132 with air. Valves with variable valve openings may be provided in the individual air ducts which are individually controllable. By individually setting the valve openings the amount of air injected by the different air injection openings can be set. Alternatively, the air pressure in the individual air ducts may be controlled in order to control the amount of air injected through the different air injection openings.

In the second embodiment the use of all or part of the air injection openings 28, 130, 132 at various engine load condition provides flexible control on fuel placement through a wide range of engine conditions. This will enable the combustion system to accommodate changes in air density and flow rates experienced at off-design conditions more readily than it is possible with state of the art burners. For example, at low load conditions, where the air density is low, fuel penetration across the swirler air passages 14 will be limited in state of the art burners. By use of the air injection openings the penetration may be increased. To increase the penetration at low load conditions a higher degree of turbulence imposed by injected additional air is necessary than at high load conditions, where the air density is high. With high air density the same degree of fuel penetration may be achieved with less turbulence.

Although the swirler of the present embodiments has six swirler vanes and six swirler air passages, the invention may be implemented with a swirler having a different number of swirler vanes and swirler air passages. Furthermore, the fuel injection openings and/or the air injection openings need not necessarily be located in the end faces. They can, in general, additionally or alternatively be located in the end faces 22 and/or in the surface of the swirler vane support and/or in the surface of the burner head delimiting the swirler air passages.

The air flow through the air injection openings will not be very high as long as enough flow is provided to promote a downstream wake to enable fuel to be mixed with air.

The invention claimed is:

1. A gas turbine burner, comprising:

a radial swirler having an air inlet opening, an air outlet opening arranged downstream of the air inlet opening, and a swirler air passage extending from the air inlet opening to the air outlet opening which is delimited by swirler air passage walls formed at least partly by faces of a plurality of swirler vanes;

a fuel injection system having fuel injection openings arranged in at least one face of a swirler vane so as to inject fuel into the swirler air passage; and an air injection system that comprises air injection openings arranged in at least one face of a swirler vane and arranged downstream of the fuel injection openings for injecting air downstream from the fuel injection openings into the swirler air passage, wherein the air injection openings provide additional air to the air streaming through the swirler air passage from the air inlet opening.

2. The burner as claimed in claim 1, wherein the air injection system comprises a plurality of air injection openings for each swirler air passage, the injection openings being distributed over at least one swirler air passage wall of the swirler air passage.

3. The burner as claimed in claim 2, wherein the air injection system comprises a control mechanism for controlling air allocation to the distributed air inlet openings.

4. A method of mixing fuel and air in a swirling area of a gas turbine burner, the swirler air passage being delimited by swirler air passage walls formed at least partly by faces of swirler vanes, comprising:

injecting fuel into an air stream streaming through a swirler air passage; and injecting additional air downstream of the injected fuel into the air/fuel mixture stream streaming through the swirler air passage in order to produce additional turbulence.

5. The method as claimed in claim 4 wherein the additional air is injected at a plurality of different injection positions of the swirler air passage.

6. The method as claimed in claim 5, wherein a distribution of additional air to the at least two injection positions is made dependent on one or more burner conditions.

7. The method as claimed in claim 6, wherein the distribution depends on the load conditions of the gas turbine engine.

* * * * *